US008316622B2

(12) United States Patent
Jajoo et al.

(10) Patent No.: US 8,316,622 B2
(45) Date of Patent: Nov. 27, 2012

(54) CHILD-RESISTANT CAP

(75) Inventors: Vishnu Jajoo, Ujjain (IN); Anurag Somani, Ujjain (IN)

(73) Assignee: Shriji Polymers India Limited (IN)

( * ) Notice: Subject to any disclaimer, the term of this patent is extended or adjusted under 35 U.S.C. 154(b) by 315 days.

(21) Appl. No.: 12/481,931

(22) Filed: Jun. 10, 2009

(65) Prior Publication Data

US 2010/0313527 A1 Dec. 16, 2010

(51) Int. Cl.
*B65B 7/28* (2006.01)

(52) U.S. Cl. ..... 53/329; 53/490; 53/331.5; 215/220

(58) Field of Classification Search ..... 53/287, 53/331.5, 329, 490; 215/220
See application file for complete search history.

(56) References Cited

U.S. PATENT DOCUMENTS

| | | | | |
|---|---|---|---|---|
| 3,692,199 | A | 9/1972 | Mumford | |
| 3,776,407 | A | 12/1973 | Cistone | |
| 3,795,337 | A | 3/1974 | Nozawa et al. | |
| 3,795,338 | A * | 3/1974 | Swartzbaugh et al. | 215/220 |
| 3,853,236 | A | 12/1974 | Ostrowsky | |
| 3,857,505 | A | 12/1974 | Mumford | |
| 3,887,099 | A | 6/1975 | Gillman et al. | |
| 3,888,375 | A | 6/1975 | Gerk | |
| 3,944,102 | A | 3/1976 | Grau | |
| 4,241,840 | A | 12/1980 | Willis | |
| 4,364,484 | A | 12/1982 | Kinsley | |
| 4,433,789 | A | 2/1984 | Gibilisco | |
| 4,454,955 | A * | 6/1984 | Kusz et al. | 215/220 |
| 4,520,938 | A * | 6/1985 | Finke | 215/220 |
| 4,527,701 | A | 7/1985 | Schaubeck | |
| 4,570,809 | A * | 2/1986 | Archer | 215/220 |
| 4,576,315 | A | 3/1986 | Vitale | |
| 4,705,181 | A | 11/1987 | Burke | |
| 4,832,218 | A * | 5/1989 | Gibilisco | 215/220 |
| 5,005,718 | A * | 4/1991 | Buono | 215/220 |
| 5,020,681 | A * | 6/1991 | Kusz | 215/220 |
| 5,148,931 | A | 9/1992 | Minh | |
| 5,161,706 | A | 11/1992 | Weinstein | |
| 5,370,251 | A * | 12/1994 | Buono | 215/220 |
| 5,579,934 | A * | 12/1996 | Buono | 215/220 |
| 5,667,085 | A * | 9/1997 | Ogden et al. | 215/220 |
| 6,206,216 | B1 | 3/2001 | Stalions | |
| 6,802,427 | B2 * | 10/2004 | Miceli et al. | 215/228 |
| 7,815,061 | B1 * | 10/2010 | Robinson et al. | 215/220 |
| 8,056,742 | B2 * | 11/2011 | Brozell et al. | 215/220 |
| 2002/0027120 | A1 * | 3/2002 | Miceli et al. | 215/228 |
| 2003/0121877 | A1 * | 7/2003 | Brozell et al. | 215/220 |
| 2005/0055986 | A1 * | 3/2005 | Brozell et al. | 53/129.1 |
| 2005/0161425 | A1 * | 7/2005 | Morini | 215/204 |
| 2006/0108313 | A1 * | 5/2006 | Brozell et al. | 215/220 |

FOREIGN PATENT DOCUMENTS

| | | |
|---|---|---|
| DE | 2927399 A1 | 1/1981 |
| EP | 0026284 A1 | 4/1981 |
| FR | 2403274 A1 | 4/1979 |

* cited by examiner

*Primary Examiner* — Lindsay Low
*Assistant Examiner* — Eyamindae Jallow
(74) *Attorney, Agent, or Firm* — The Law Firm of Andrea Hence Evans, LLC

(57) ABSTRACT

A child resistant cap assembly for a bottle is disclosed comprising an inner cap and outer cap. When an external pressure is applied to the outer cap, the teeth on the outer cap engage with the inner cap. While engaged, the cap assembly is rotated in a counter clockwise direction to unfasten or unscrew the cap assembly from the bottle.

8 Claims, 4 Drawing Sheets

CHILD-RESISTANT CAP

CROSS REFERENCE TO RELATED APPLICATIONS

None.

FIELD OF THE INVENTION

The present invention relates to a child resistant cap assembly, and more particularly, an assembly having an outer cap and an inner cap which engage by radial and linear contact to facilitate screwing and unscrewing the cap assembly.

BACKGROUND OF THE INVENTION

The contents of bottles or containers can be toxic to children. Thus, it is necessary to provide closure devices or caps that are child resistant. That is, the cap needs to prevent a child from easily opening the bottle to avoid the risk of injesting the contents.

Additionally, the elderly and senior citizens require a cap that is senior friendly. Seniors should not over exert themselves when trying to open bottles. This can result in injury or inhibit them from reaching the contents of bottle.

SUMMARY OF THE INVENTION

The present invention provides a cap assembly comprising an outer cap having at least one hinge extending from a bottom surface of the outer cap and an inner cap having at least one undercut along an inside rim of the inner cap.

It is an aspect of an embodiment of the present invention to provide inner cap teeth along an outer periphery of the inner cap and outer cap teeth along an inside of the outer cap.

It is a further aspect of an embodiment of the present invention to provide that when a pressure exerted on top of the outer cap, the hinges are compressed and the outer cap engages with the inner cap.

It is a further aspect of an embodiment of the present invention to provide a method of using a cap assembly comprising an inner cap and an outer cap.

It is a further aspect of an embodiment of the present invention to provide fitting the inner cap inside the outer cap, wherein a distance is provided between the bottom surface of the outer cap and the top surface of the inner cap.

It is a further aspect of an embodiment of the present invention to provide exerting a pressure on the outer cap such that the hinge is compressed and the distance between the bottom surface of tile outer cap and the top surface of the inner cap is decreased.

DETAILED DESCRIPTION OF THE INVENTION

Figure 1:
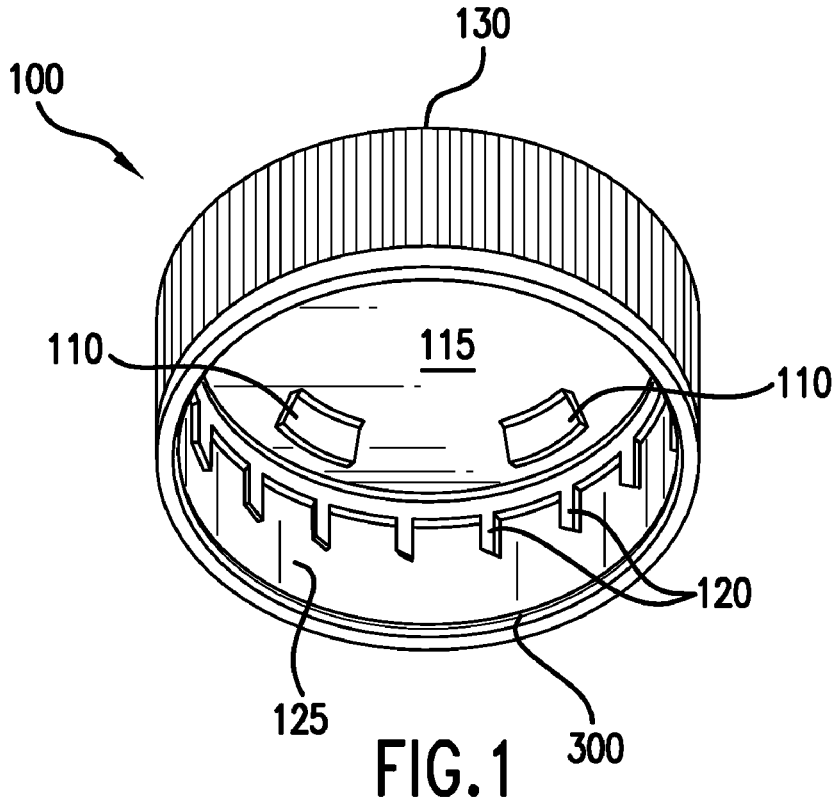
FIG. 1 is a perspective view of the outer cap.

A cap assembly 800 comprises an outer cap 100 and an inner cap 200. The cap assembly 800 can be designed to be any size suitable to fit on a desired bottle 810. Also, the threads 220 on the inner cap 200 can also be sized and structured to match the threads (not shown) on the bottle 810.

Figure 7A:
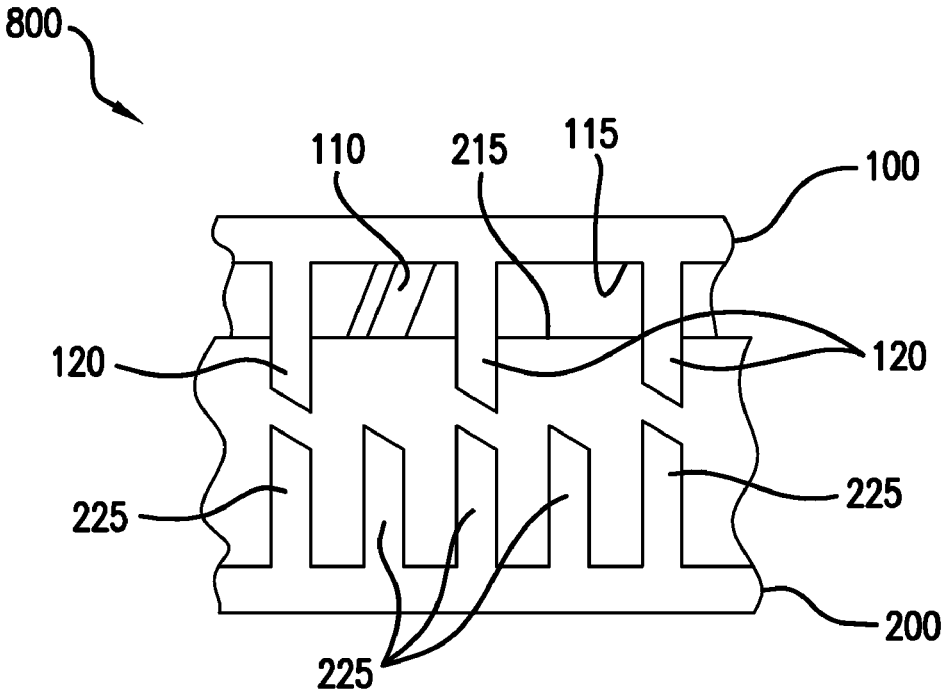
FIG. 7*a* is a schematic view of the cap assembly showing an interaction between the inner cap teeth and outer cap teeth.

FIG. 1 is a top perspective view of the outer cap 100. The outer cap 100 has a matty finish. Additional textured finishes may be provided on the outer cap 100 to aid in gripping it. The outer cap 100 has at least one hinge 110 extending from a bottom surface 115 of the outer cap 100. Four hinges 110 are shown in FIG. 1, however additional or less hinges 110 may be provided. The hinges 110 are composed of thermoplastic resins, a basic raw material such as polypropylene. The hinges 110 are thin wafer-like inclined projections that function like a spring mechanism. The properties of polypropylene allow the hinges 110 to compress when all external pressure is applied in a downward direction on the top 130 of the outer cap 100. The hinges 110 act like a cushion between the inner cap 200 and the outer cap 100. The bottom of the hinges 110 contact the top 215 of the inner cap 200. Outer cap teeth 120 are positioned along the inside or inner periphery 125 of the outer cap 100. The exertion of pressure onto the outer cap 100 causes the outer cap teeth 120 to engage with the inner cap teeth 225, as shown in FIG. 7A. There are at least 32 inner cap teeth 225. The ratio of inner cap teeth 225 to outer cap teeth 120 is 2:1. Any ratio between the teeth may be employed.

The outer cap 100 mounts on the outer periphery 210 of the inner cap 200. The cap assembly 800 further comprises a retainer ring 300 provided at an inside 125 of the outer cap 100. The retainer ring 300 prevents the inner cap 200 from being removed from the outer cap 100 once it is fitted inside the outer cap 100. The retainer ring 300 is provided to retain the inner cap 200 inside the outer cap 100. This is plausible because the diameter of the retainer ring 300 on the inside of the outer cap 100 is less than that of the outer diameter of the inner cap 200.

Figure 2:
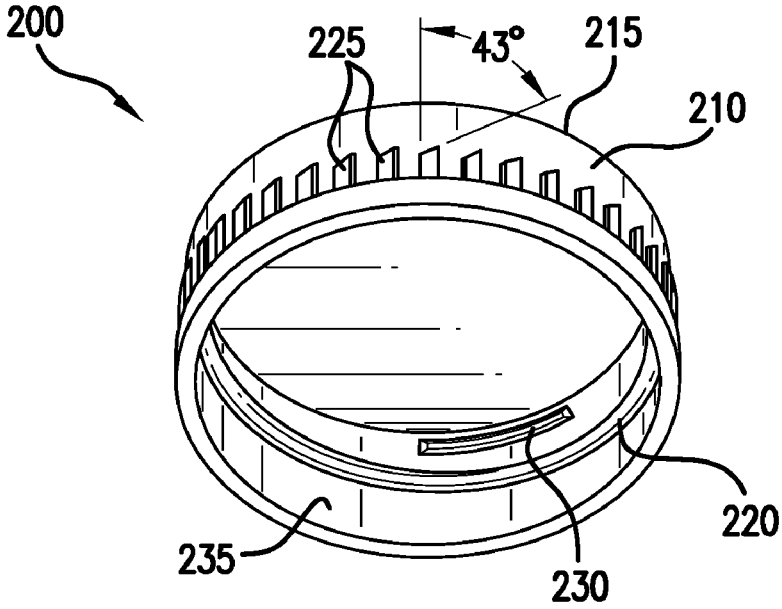
FIG. 2 is a perspective view of the inner cap.
Figure 7B:
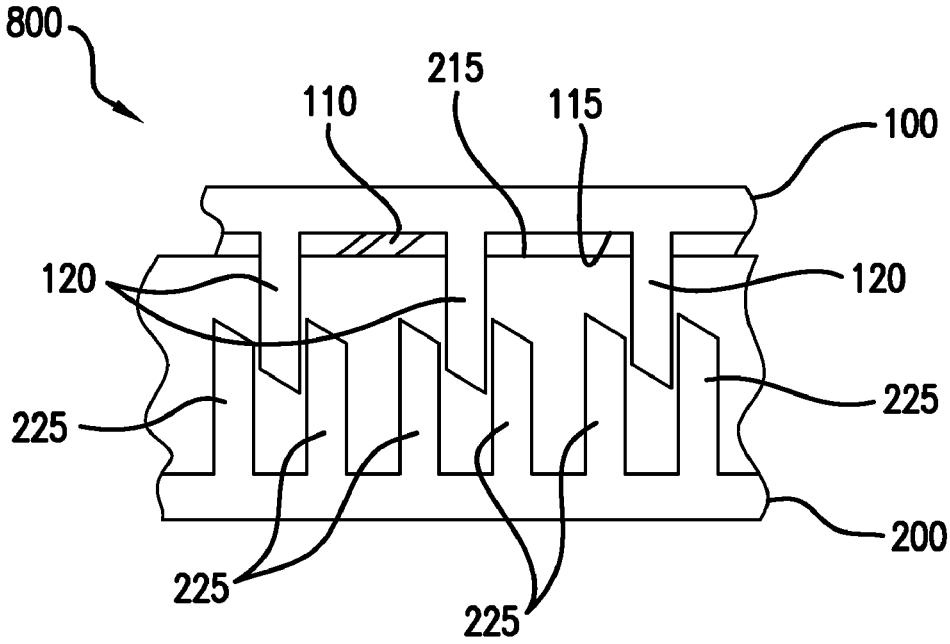
FIG. 7*b* is a schematic view of the cap assembly showing an alternate interaction between the inner cap teeth and outer cap teeth.

FIG. 2 is a perspective view of the inner cap 200. The inner cap 200 is coaxially positioned within the outer cap 100. The inner cap 200 has at least one undercut 230 along an inside rim 235 of the inner cap 200. The undercuts 230 are designed for the purpose of retaining the liner. The liner is fixed to the bottom surface of the inner cap in order to keep the contents of the container or bottle isolated from the external atmospheric condition. Additionally, the liner prevents leakage by providing proper sealing. Inner cap teeth 225 are positioned along the outer periphery 210 of the inner cap 200. The inner cap teeth 225 are equally spaced apart from each other and are aligned in the axial direction of the inner cap 200. The outer cap teeth 120 and the inner cap teeth 225 can be slanted or tapered at the edge, as shown in FIG. 7B. The tapering aids in providing the teeth 120, 225 of the inner and outer caps to slip or slide when a person attempts to open the cap without applying downward pressure (pushing the cap downward). The angle that the vertical axis makes with the tapered or slanted service ranges between 35° to 55°. This angle may be 43°, shown in FIG. 2. The inner cap teeth 225 are smaller in size and spaced closer to each other versus the outer cap teeth 120. The outer cap teeth 120 are longer and spaced further apart than the inner cap teeth 225.

Figure 3:
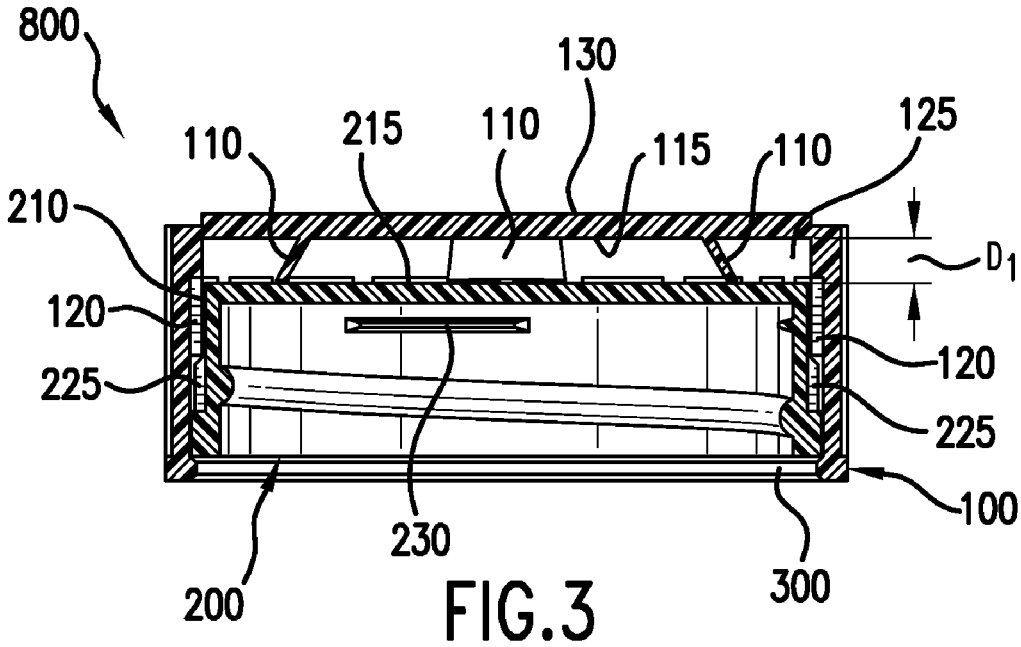
FIG. 3 is a perspective view of the inner cap engaged with the outer cap before exerting pressure.

FIG. 3 is a perspective view of the inner cap 200 engaged with the outer cap 100 before exerting pressure. A distance D1 is provided between the hinges 110 and an outer top portion 215 of the inner cap 200. D1 may be approximately 3 mm. When the cap assembly is in a position before pushing, distance D1 is the distance between the bottom surface 115 of the outer cap 100 and the top surface 215 of the inner cap 200. D1 is the distance provided through hinges 110 or the spacing between the hinges 110.

Figure 4:
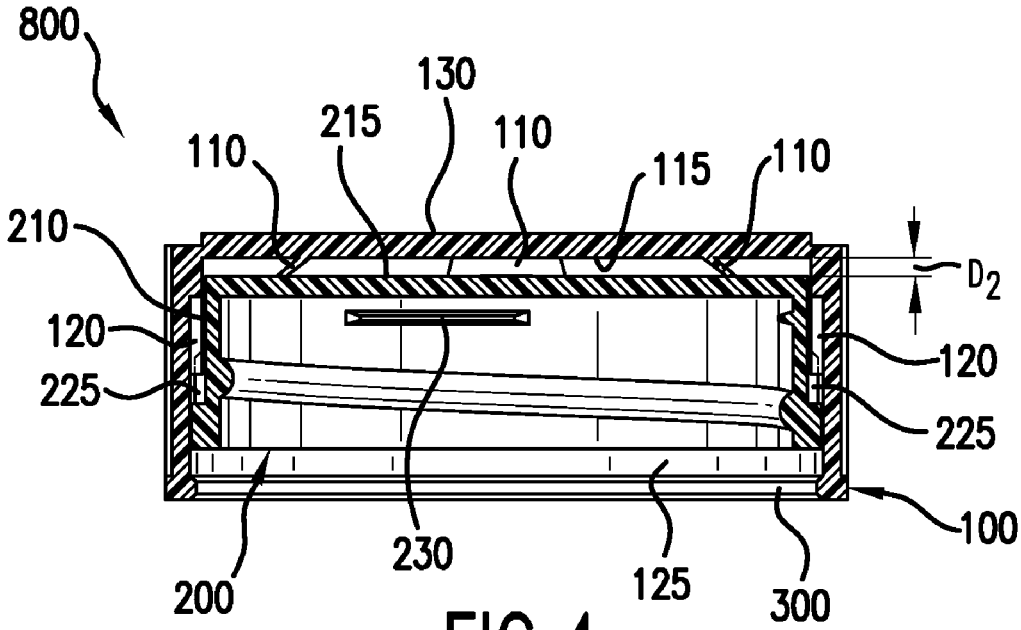
FIG. 4 is a perspective view of the inner cap engaged with the outer cap after exerting pressure.

FIG. 4 is a perspective view of the inner cap 200 engaged with the outer cap 100 after exerting pressure. The cap assembly 800 is used to cover a bottle 810. The assembly 800 is to be pushed and rotated simultaneously to engage or disengage the assembly 800 from the bottle 810. This pushing is the pressure necessary to engage the outer cap 100 and inner cap 200. When this pressure is exerted on the outer cap 110 the hinges 110 are compressed, the distance D2 shown between the outer cap 200 and the inner cap 100 is reduced through the binges 110. Due to tension in the hinges 110, the hinges 110 are easily compressed and the distance is reduced to D2, about 1 mm. This reduction in distance would then enable the teeth on the sidewall of the two caps to engage with each other which would further result in opening the cap assembly when the concurrent motion (i.e. push and turn anti-clockwise) is applied on the cap assembly.

Figure 5:
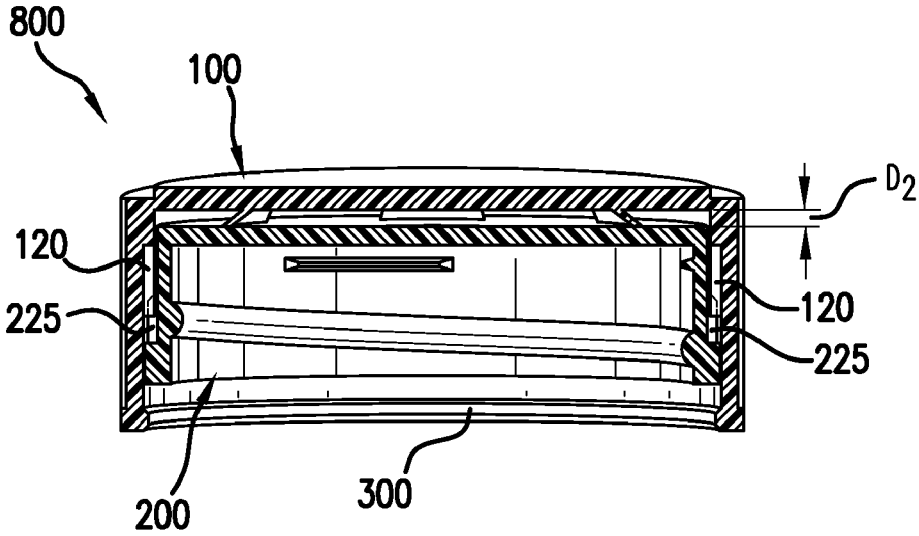
FIG. 5 is a side perspective view of the inner cap engaged with the outer cap after exerting pressure.

FIG. 5 is a side perspective view of the inner cap 200 engaged with the outer cap 100 after exerting pressure. Screwing and unscrewing the cap assembly 800 requires concurrent motion such as turning the cap assembly 800 and pushing downward thereby engaging the inner cap teeth 225 and outer cap teeth 120. Additionally, rotating the cap assembly 800 engage the inner cap teeth 225 with the outer cap teeth 120. The rotating and pushing of the cap assembly 800 are simultaneous. When the cap assembly 800 is rotated the outer cap 100 rotates in the same direction as that of the inner cap 200. When the inner and outer cap engage, the two components become one assembly. Therefore, when the cap assembly 800 is rotated, it will move in the same direction.

Figure 6:
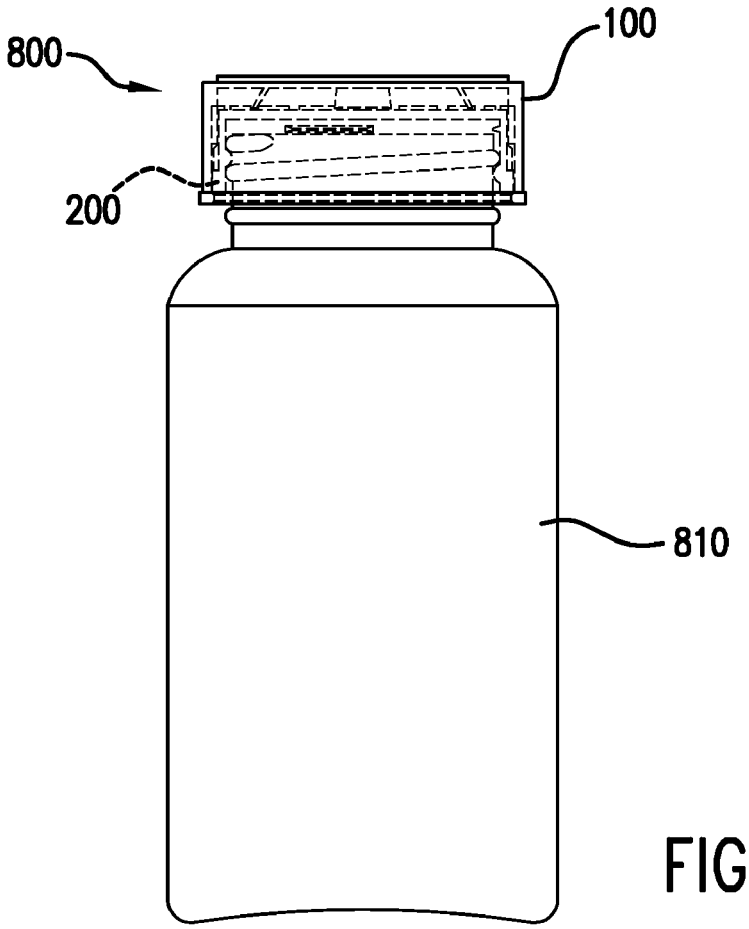
FIG. 6 is a perspective view of the cap assembly on a bottle.

FIG. 6 is a perspective view of the cap assembly 800 on a bottle 810. The cap assembly 800 is rotated in a counter clockwise direction to unfasten or unscrew the cap assembly from the bottle 810. When rotated or screwed in a clockwise direction, the cap assembly 800 is fastened or secured to the bottle 810.

The invention has been described in detail with particular reference to certain preferred embodiments thereof, but it will be understood that variations and modifications can be effected within the spirit and scope of the invention.

The invention claimed is:

1. A cap assembly comprising:

an outer cap having hinges extending from a bottom surface of the outer cap to a top of an inner cap, wherein the hinges are vertical inclined projections angled between 45° to 60° from the bottom surface of the outer cap which form an arc-like shape around the bottom surface of the outer cap positioned every 90 degrees;

wherein the hinges provide a distance D1 between the outer cap and inner cap in a resting position;

inner cap teeth extending in a vertical direction along an outer periphery of the inner cap;

outer cap teeth extending in a vertical direction along an inside of the outer cap inner periphery wall;

wherein a ratio of the inner cap teeth to outer cap teeth is 2:1;

wherein the inner cap teeth and outer cap teeth have angled edges;

wherein the distance D1 is about 3 mm between the bottom surface of the outer cap and the top surface of the inner cap and the distance D1 is reduced to distance D2 which is about 1 mm when a pressure is exerted on the cap assembly compressing all of the hinges in an engagement position which engage the inner cap teeth and outer cap teeth.

2. The cap assembly of claim 1 further comprising the inner cap is fitted inside the outer cap.

3. The cap assembly of claim 1 further comprising the inner cap is coaxially positioned within the outer cap.

4. The cap assembly of claim 1 wherein the inner cap teeth are equally spaced apart from each other.

5. The cap assembly of claim 4 further comprising wherein the inner cap teeth are aligned in the axial direction of the inner cap.

6. A cap assembly comprising:

an outer cap having hinges extending from a bottom surface of the outer cap to a top of an inner cap, wherein the hinges are vertical inclined projections angled between 45° to 60° from the bottom surface of the outer cap which form an arc-like shape around the bottom surface of the outer cap positioned every 90 degrees;

wherein the hinges provide a distance D1 between the outer cap and inner cap in a resting position;

an inner cap having at least one undercut along an inside rim of the inner cap;

inner cap teeth extending in a vertical direction along an outer periphery of the inner cap; and outer cap teeth extending in a vertical direction along an inside of the outer cap inner periphery walls;

wherein a ratio of the inner cap teeth to outer cap teeth is 2:1;

wherein the inner cap teeth and outer cap teeth have angled edges;

wherein the distance D1 is about 3 mm between the bottom surface of the outer cap and the top surface of the inner cap and the distance D1 is reduced to distance D2 which is about 1 mm when a pressure is exerted on the cap assembly compressing all of the hinges in an engagement position which engage the inner cap teeth and outer cap teeth.

7. The cap assembly of claim 6, wherein the hinge is composed of thermoplastic resins.

8. The cap assembly of claim 6 further comprising a bottle, wherein the assembly is to be pushed and rotated simultaneously to disengage the assembly from the bottle.

* * * * *